US005904279A

United States Patent [19]

Bertram et al.

[11] Patent Number: 5,904,279

[45] Date of Patent: May 18, 1999

[54] METHOD AND APPARATUS FOR STRAIGHTENING SUBSTANTIALLY TUBULAR TEXTILE GOODS

[75] Inventors: Wolfgang Bertram, Charlotte, N.C.; Siegfried Leonhardt, Stockach-Wahlwies, German Dem. Rep.

[73] Assignee: Wepamat Maschinenbau GmbH, Weiheim, Germany

[21] Appl. No.: 08/890,812

[22] Filed: Jul. 11, 1997

[30] Foreign Application Priority Data

Jul. 11, 1996 [DE] Germany ..... 196 27 812

[51] Int. Cl.[6] ..... A47G 25/90

[52] U.S. Cl. ..... 223/112; 223/75

[58] Field of Search ..... 223/75, 77, 76, 223/112

[56] References Cited

U.S. PATENT DOCUMENTS

| | | | |
|---|---|---|---|
| 2,189,650 | 2/1940 | Ischinger | 223/77 |
| 2,493,803 | 1/1950 | Butler | 223/76 |
| 2,705,827 | 4/1955 | Gamache . | |
| 2,865,542 | 12/1958 | Smith | 223/77 |
| 3,420,196 | 1/1969 | Edwards et al. | 223/75 |
| 3,486,471 | 12/1969 | DeSpain | 223/75 |
| 4,308,980 | 1/1982 | Gazzarrini . | |
| 4,383,491 | 5/1983 | Hodges . | |
| 5,316,188 | 5/1994 | Froehlich et al. | 223/77 |
| 5,402,733 | 4/1995 | Humpherys . | |
| 5,497,235 | 3/1996 | Bell . | |
| 5,505,350 | 4/1996 | Migliorini | 223/75 |
| 5,531,173 | 7/1996 | Migliorini . | |

FOREIGN PATENT DOCUMENTS

| | | | |
|---|---|---|---|
| 2 214 421 | 8/1974 | France . | |
| 697573 | 10/1951 | United Kingdom | 223/75 |

*Primary Examiner*—Bibhu Mohanty
*Attorney, Agent, or Firm*—Alston & Bird LLP

[57] ABSTRACT

The present invention relates to a method and an apparatus for straightening substantially tubular textile goods, such as socks, stockings, tights etc., which have an asymmetry, such as a reciprocated heel. According to the invention the textile goods are drawn onto a substantially cylindrical form, the form with the textile product drawn onto it is rotated about a longitudinal axis, during rotation the asymmetry position is detected as is the position of the form and finally the form is rotated into a predetermined position corresponding to the detected asymmetry position. Preferably, simultaneously the stitch pattern of the textile product drawn onto the form is inspected for faults and flaws.

14 Claims, 4 Drawing Sheets

METHOD AND APPARATUS FOR STRAIGHTENING SUBSTANTIALLY TUBULAR TEXTILE GOODS

TECHNICAL FIELD

The present invention relates to a method and an apparatus for straightening substantially tubular textile goods, particularly stockings, tights, socks, etc., which have an asymmetry.

BACKGROUND OF THE INVENTION

Asymmetry is understood to mean both a shape asymmetry, such as e.g. the heel reciprocation of a stocking or the toe seam of a sock, as well as a colour or weave asymmetry, such as e.g. a woven in tracer thread. In addition, textile goods not only cover woven and knitted goods made from fibrous materials, but also those produced in other ways from other materials, which have comparable characteristics, particularly with regards to elasticity and surface properties.

With few exceptions, socks and stockings are produced on circular knitting machines with a so-called reciprocated heel. The socks leave the knitting machine substantially in the form of a tube, having at the end a special shape known as the gore-line. This end is closed with a seam and then forms the sock toe. In the cross-section of the textile product the toe seam and heel are at right angles to one another.

Following toe sewing, as well as following knitting, the socks are bleached or dyed. They leave the bleaching or dyeing plants in an unattractive form comparable to that of socks after washing and must then be brought into a saleable state by shaping. In additions the textile goods have to be inspected for knitting or weaving faults or flaws, in order to eliminate faulty products. For this purpose it is known to draw the socks or stockings onto a flat plate and then examine them from both sides.

These operations involve a large amount of tiresome manual work and rapidly lead to fatigue and consequently to errors on the part of the person carrying out this work.

It is therefore an object of the invention to simplify and improve the handling, processing and inspection of textile goods between the initial production stages such as knitting and dyeing and the final production stages such as shaping, folding or packing, whilst in particular reducing the extensive, tiresome manual work.

SUMMARY OF THE INVENTION

According to the invention this problem is solved by a method of the aforementioned type, in which the textile product is drawn onto a substantially cylindrical form, the form together with the textile product drawn onto it is rotated about a longitudinal axis, during the rotation the position of the asymmetry and the position of the form are detected and the form is rotated into a predetermined position corresponding to the detected asymmetry position.

The textile products can be drawn onto the form in a completely unstraightened manner, in a random positions e.g. from a basket or directly from a bleaching or dyeing plant and are automatically straightened into a predetermined position without manual work in which they can be transferred to a further processing machines. The drawing of the textile product onto a substantially cylindrical form facilitates to a significant extent the detection of the textile product asymmetry.

Preferably the textile product is drawn onto the form in such a way that, with the exception of the asymmetry, the product engages smoothly on the form and the textile product portion projecting from the form is detected Particularly in the case of socks or stockings with a reciprocated heel, the sock or stocking is drawn onto the form in such a way that the product engages on the outer surface of the form in a slightly stretched manner without folds and only has a bulge or bead in the vicinity of the reciprocated heel. The position of this bead is then detected as a parameter determining the textile product orientation and is used for straightening the product.

As the orientation-determining parameter, it is also possible to use for straightening-purposes the position of a toe seam, which is detected as an asymmetry of shape in the state drawn onto the form. According to an embodiment of the invention it is also possible to detect a colour asymmetry or a weave asymmetry, such as e.g. a tracer thread as the product orientation-determining parameter and can be used for the straightening thereof.

According to a preferred embodiment of the invention the form with the textile product drawn onto it, is rotated by at least 360°.

According to another aspect of the invention the textile product drawn onto the substantially cylindrical form is inspected for weaving and/or knitting flaws, accompanied by form rotation. By drawing the tubular textile product onto the substantially cylindrical form the product is subject to a uniform stretching, so that the stitch pattern can be simply and accurately detected.

If the textile product is drawn in known manner onto a flat, plate-like form, at the edges the product is subject to a high stretching or loading and overall to a non-uniform stretching. The textile product stitch pattern cannot be detected at the edges and the stitch pattern detected on the sides of the form cannot be correctly evaluated due to the non-uniform stretching. The drawing of the textile product onto a substantially cylindrical form leads to a uniform stretching. The stitch pattern can be uniformly detected. This can also take place without rotating the form, but preferably the form is rotated. Appropriately the stitch pattern is inspected simultaneously with the detection of the asymmetry position.

Preferably portions of the textile product are successively detected by means of an optical pattern detection device and are compared with one another. A portion which has just been detected can be compared with the previously detected portion or with a mean value of previously detected portions.

According to another aspect of the invention the aforementioned problem is solved by an apparatus of the aforementioned type with at least one substantially cylindrical form, a rotating device for rotating the form about a longitudinal axis, a detecting device for detecting the position of the asymmetry relative to the angular position of the form and a control device for controlling the rotating device as a function of the detected asymmetry position and the corresponding form position.

The term substantially cylindrical also covers shapes which diverge from the mathematical cylindrical shape and which are e.g. slightly conical or in meridian section have a slightly convex contour. However, preference is given to a cylindrical form.

According to a preferred embodiment of the invention, the detecting device has a sensor, which detects the presence of the asymmetry in a predetermined area. The sensor can detect the asymmetry if rotated through a predetermined detection area during the rotation of the form.

As a function of the parameter determining the textile product orientation it is possible to use various sensors. For detecting a weave asymmetry, such as e.g. a metallic tracer thread, a corresponding detector can be provided as the sensor. For detecting an asymmetry of shape, such as e.g. a reciprocated heel projecting in bead-like manner from the form a feeler can be provided. However, preferably an optical sensor is provided, which detects the passage of the asymmetry through the detection area.

According to a preferred embodiment of the invention a circumference of the form is dimensioned in such a way that the textile product is stretched in the state drawn onto the form, but is not overstretched, more particularly in such a way that the textile product in the vicinity of the asymmetry projects from the form and in the other areas smoothly engages on the form The form is consequently so constructed that a reciprocated heel of a sock projects in bead-like manner from the form surface, whilst otherwise the sock engages smoothly on the form.

According to another aspect of the invention a testing or inspecting device is provided for the inspection of the stitch pattern of the textile product in the state drawn onto the substantially cylindrical form which significantly simplifies the checking of textile products for faults or flaws. Due to the fact that a substantially cylindrical form is used, the textile products are uniformly stretched, which gives rise to a uniform stitch pattern and flaws can be easily detected.

Appropriately the inspection device has an optical pattern detection device for detecting the stitch pattern and preferably a storage device for storing a detected stitch pattern, a comparator for comparing a detected stitch pattern with a stored stitch pattern and an evaluating device for evaluating the comparison result. The parameter determining whether or not there is a flaw can be constituted by the divergence of the just detected pattern from the stored pattern. For example, brightness can be used for this purpose. If the divergence exceeds a predetermined value, a flaw exists.

The inspection of the stitch pattern can also take place in that the patterns detected by the pattern detecting device are digitized by a digitizing unit and subsequently binarized with a binarizing unit. The binarization threshold can be set in accordance with the textile product to be inspected If the ratio of the binary values exceeds a threshold, the presence of a hole can be assumed.

Advantageously the inspection device carries out a portionwise inspection of the textile product drawn onto the cylindrical form, accompanied by form rotation. According to a preferred embodiment of the invention the stitch pattern is inspected in conjunction with the asymmetry position detection and appropriately the position of a flaw is detected and stored relative to the particular form position. The corresponding signals can then be processed together with the corresponding signals determining the asymmetry position, so as to determine the position of a fault. Thus, the position of a fault is detected and determined relative to the alignment of the textile product. This has the advantage that the fault source can be more easily determined in the case of faults accumulating at the same location.

To facilitate the optical or visual detection of the textile product, appropriately an illuminating or lighting device is provided, which intensifies brightness differences between faultless and faulty areas, particularly a hole. A particularly simple arrangement is obtained by positioning the illuminating device on the form side opposite to the stitch pattern detection device. Appropriately the form is transparent for this purpose.

In order to bring about an effective illumination of the textile product area which has just been inspected, the illuminating device can also advantageously be located within the draw-on form. The pattern detection device and illuminating device are consequently advantageously so positioned that the textile product extends only in single-layer form between them.

According to a further development of the invention the form can also be opaque and preferably the form has a different brightness and/or colour compared with the textile product to be inspected. As a result flaws in the stitch pattern can be detected compared with the opaque form.

According to a further development of the invention there are a slip-on station for slipping the textile products onto a form a draw-on station for drawing the textile products onto a form, a detection and/or inspection station and/or a draw-off station for drawing the textile products from the form. Preferably a plurality of forms exists, which are movable between the stations or from station to station. This has the advantage that the individual method steps can be performed in time-parallel manner with several textile products and that the handling, processing or inspection of the socks and stockings between the initial product stages such as knitting or dyeing and bleaching and the subsequent processing stages such as shaping, folding or packing are largely automated.

According to a further development of the invention a draw-on device is provided for drawing the textile products onto a form, the draw-on device having at least one draw-on part movable relative to the form and in particular at least one revolving draw-on belt. Preferably there are several draw-on belts distributed over the form circumference and engaging on the textile products, which uniformly draw the products by friction between the same and the belts onto the form.

According to a preferred embodiment of the invention the draw-on device has several sword-like conveying units with in each case at least one conveyor belt, which can be moved towards and away from the form. The movable conveyor units can consequently be moved towards the form so as by contact of the conveyor belts with the textile product to draw the latter onto the form and can be moved away from the form in order to e.g. move the form to a further processing or working station.

Advantageously the draw-on device can be integrated into the form. The form can have several conveyor belts arranged on its outside with the aid of which the textile products can be drawn onto the form.

According to a further development of the invention the form cross-section can be adjustable. Preferably the cross-section is adjustable in such a way that in a first position the textile product is pressed with a relatively high pressure onto the draw-on parts and in a second position the draw-on parts do not or only slightly project compared with the outer contour of the form. For this purpose the form preferably has several components movable radially to the longitudinal axis of the form.

Preferably the apparatus also has a draw-off device for drawing the textile product from the form, the draw-off device having at least one draw-off part movable relative to the form, particularly a revolving draw-off belt and preferably several conveyor units movable relative to the form with in each case at least one draw-off part. The draw-off device can be constructed in substantially the same way as the draw-on device.

According to another aspect of the invention a twisting of the tubular textile products along the longitudinal axis thereof, i.e. a twist of e.g. a top of a sock with respect to the toe of the foot can be largely eliminated or significantly reduced on drawing the textile product off the form The textile product drawn onto the form is drawn off the form by a draw-off device and during the drawing off operation the form is rotated relative to the draw-off device. Rotation of the form about its longitudinal axis relative to the draw-off device merely means a relative rotation between the form and the draw-off device, i.e. the draw-off device and/or the form can be rotated. Whilst the textile product is drawn from the form the textile product part still on the form is rotated counter to the twist compared with the already drawn off part. Appropriately the draw-off device is so constructed or is at least so adjustable for this process, that it is not the complete textile product portion drawn onto the form which engages with the draw-off device and instead preferably only the product portion which has just slid from the form. The draw-off device, with respect to which the form is rotatable, can also be part of a conveying away means with which the textile products are conveyed on and away from the form. Untwisting also leads to advantages with symmetrical textile products, particularly with respect to the subsequent shaping to make them saleable.

The amount of the rotation of the form and/or the draw-off device during drawing off can be preset. The form is in each case rotated by a fixed amount with respect to the draw-off device. The amount of the rotation can be adjustable and can in particular be inputted by the machine operator. The twisting of the textile goods is substantially dependent on the machine At with which the textile product is knitted, woven, etc. The twist is substantially constant for textile goods of the same batch.

According to a further development of the invention the twisting of the textile goods drawn onto the form can be automatically detected by a corresponding detection unit. Corresponding to the determined twist amount, the form can be rotated relative to the draw-off device on drawing off the textile product, so that the twist is precisely eliminated. The relative rotation between the form and the draw-off device can be linearly controlled between the two end points. To obtain an even more exact twist elimination, the relative movement can be incrementally controlled corresponding to the detected twist.

Twisting detection can take place in optical or sensory manner. For example, a tracer thread woven in in the longitudinal direction of the textile product can be detected. It is also possible to detect on the form the position of singular asymmetries, such as e.g. the toe seam, the heel bead and a further characteristic mark on the textile product top. With the detected textile product twist, the relative rotation between the draw-off device and the form is so controlled that the twist is eliminated on drawing off.

These and other features can be gathered from the claims, description and drawings and the individual features, both singly and in the form of subcombinations, can represent advantageous, independently protectable embodiments for which protection is hereby claimed

BRIEF DESCRIPTION OF THE DRAWINGS

The invention is described in greater detail hereinafter relative to embodiments and the attached drawings, wherein show.

DETAILED DESCRIPTION OF THE PREFERRED EMBODIMENT

Figure 1:
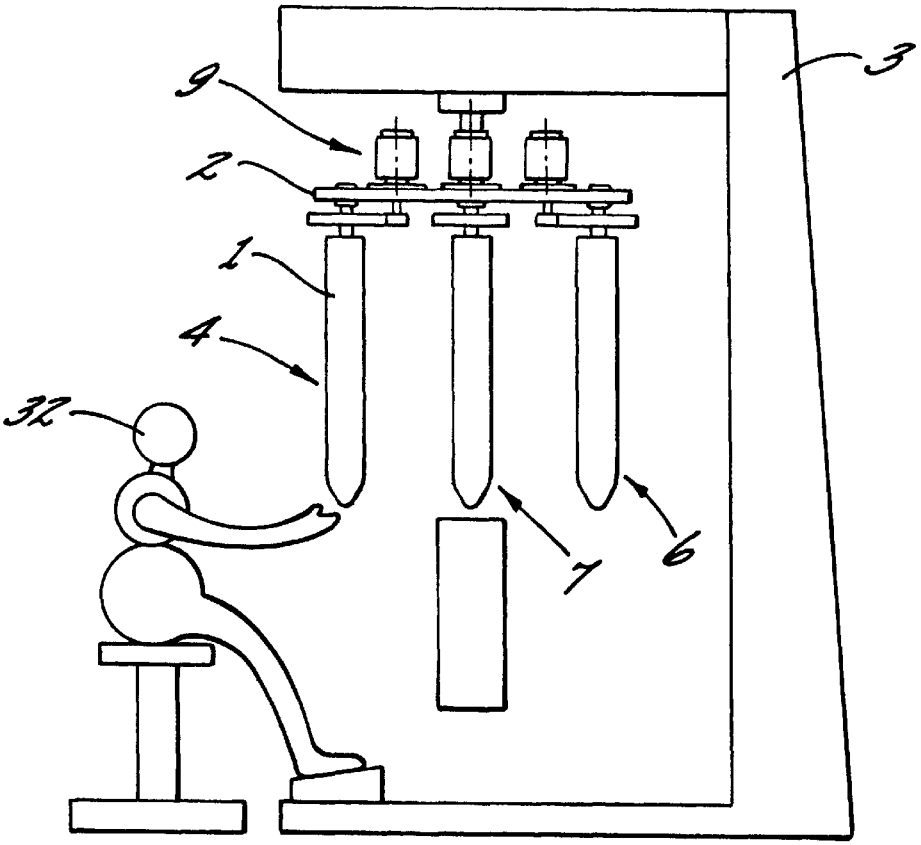
FIG. 1 A side view of an apparatus for straightening and inspecting textile goods according to a preferred embodiment of the inventions there being several forms for drawing on textile goods, a movement device and a support and an operator slipping textile goods onto the forms.
Figure 3:
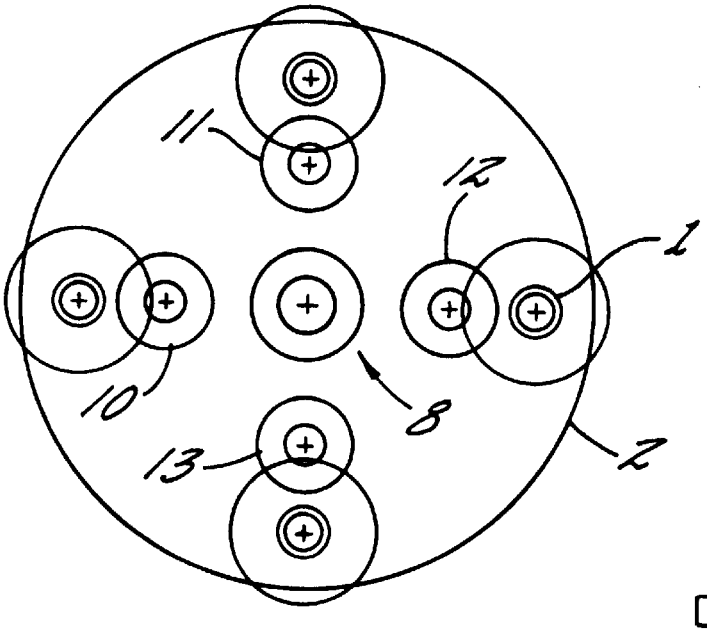
FIG. 3 A plan view of the forms and the common support in the larger scale of FIG. 2.

As shown in FIGS. 1 and 3 the apparatus for straightening and inspecting tubular textile goods has four forms 1, which are mounted in downwardly hanging manner on a common revolving or rotary plate 2 acting as a support and which is in turn mounted in suspended manner on a support 3.

The apparatus is constructed as a rotary transfer machine, in which a plurality of working stations 4, 5, 6, 7 are arranged along the circumference of the revolving plate 2. There are successively a slip-on station 4, in which the textile goods are manually slipped on to a point or tip of a form 1, a draw-on station 5, in which the textile goods are drawn onto the forms 1, a position detection and inspection station 6 and a draw-off and transfer station 7, where the textile goods are drawn from the forms 1 and transferred to a conveying away means.

In order to be able to index the forms 1 from station to station, a first rotating device 8 is provided, which can rotate the revolving plate 2 about a vertical axis by means of a drive motor.

Figure 2:
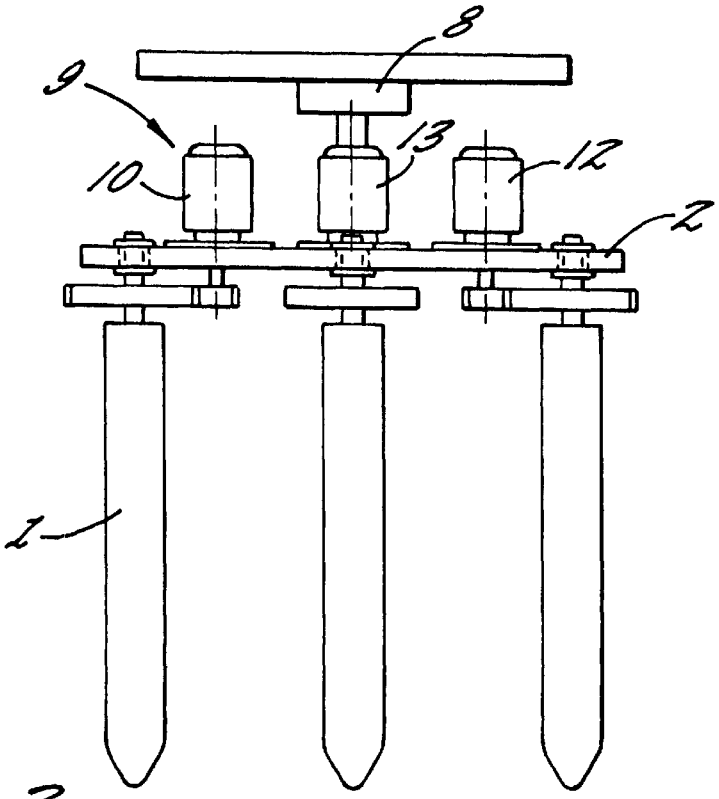
FIG. 2 A larger scale detail of the forms mounted on a common support and the associated movement device according to the embodiment of FIG. 1.

The forms 1 are also mounted so as to rotate about their longitudinal axis on the revolving plate 2 and can be individually rotated about their longitudinal axis by a second rotating device 9. For this purpose the rotating device 9 has in each case a drive motor 10, 11, 12 and 13 associated with a particular form 1 (cf. FIGS. 2 and 3).

Figure 5:
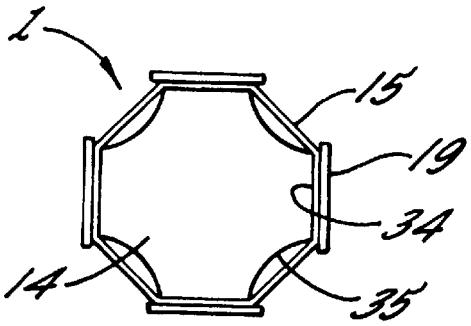
FIG. 5 A cross-section through the form according to FIG. 4.
Figure 8:
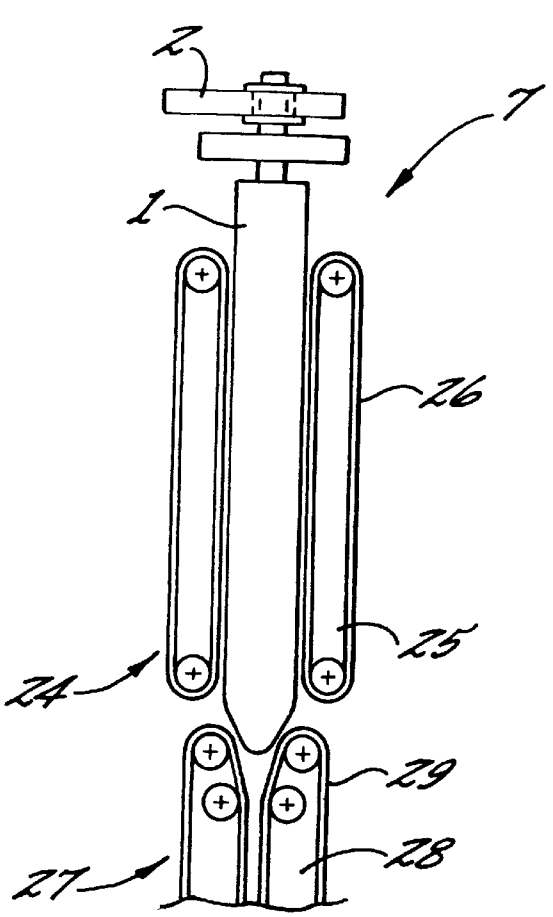
FIG. 8 A draw-off station, in which a pivotable draw-off device is pivoted up to a form and draws the textile goods from the form and transfers them to a conveying away means.

The forms 1 have in each case substantially cylindrical hollow profile elements made from a transparent material with an octagonal cross-section, which alternatively have substantially planar jacket segments 34 for drawing on the textile goods and concave jacket segments 35 for reducing friction (FIG. 5). The cross-section could also be circular. However, an octagonal cross-section according to FIG. 5 allows a low-friction drawing on of the textile goods 15 and also only has a limited influence on the stitch pattern of the drawn on textile product 15. At a lower end of the hollow profile element 14, its cross-section passes into a rounded, closed, roughly spherical segmental tip 16.

Figure 4:
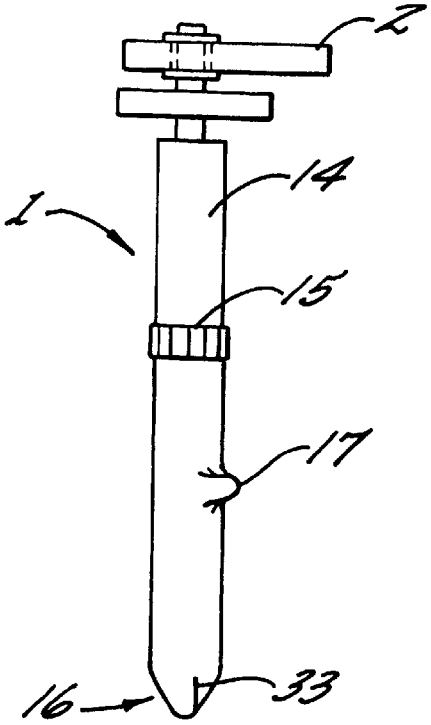
FIG. 4 A side view of a form onto which have been drawn the textile goods.

As shown in FIG. 4, a form 1 constructed in this way ensures that a textile product, such as e.g. a sock 15, in the drawn on state engages in slightly stretched smooth manner onto the outer surface of the form 1 and only has a bead-like fold in the vicinity of a reciprocated heel 17 and projects from the surface of the form 1. Apart from this the textile product 15 is substantially uniformly slightly stretched.

Figure 6:
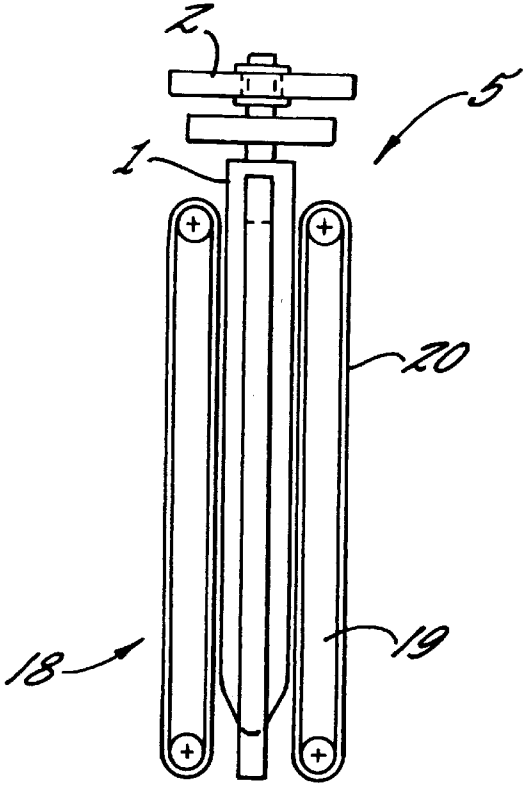
FIG. 6 A draw-on stations in which a pivotable draw-on device has been pivoted up to a form, in side view according to the embodiment of the preceding drawings.

In order to automatically draw a textile product 15 onto the form 1, in the draw-on station 5 is provided an automatic draw-on device 18, which has a pair of pivotable conveying units 19, which in turn have a draw-on part in the form of a pair of revolving conveyor belts 20 (cf. FIG. 6). The conveyor units 19 can be so pivoted up to the form 1 that in each case a strand of the conveyor belt 20 facing the form 1 runs substantially parallel to the outer surface of the form 1 in the longitudinal direction thereof. The conveyor units 19 are located on opposite sides of the form 1 in the position pivoted up to said form, so that the form 1 is positioned in tong-like manner between the conveyor belts 20 (FIG. 6).

Figure 7:
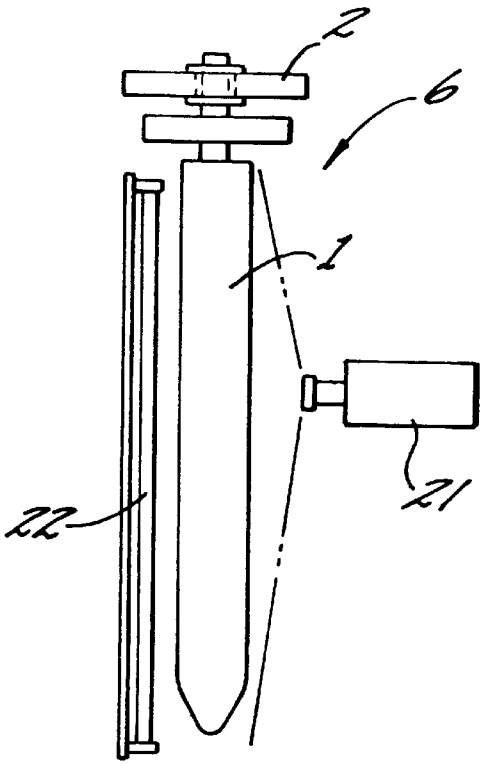
FIG. 7 An inspection and detection device having a pattern processing device and an illuminating devices between which is positioned a form.

In order to be able to visually or optoelectronically inspect for a faultless stitch pattern a textile product 15 drawn onto the form 1, the inspection station 6 contains a stitch detection device 21, which is directed from one side onto the circumferential surface of a form 1 located in the inspection station 6 (FIG. 7). With respect to the stitch pattern detection device 21, on the opposite side of the form 1 the inspection station 6 contains as the illuminating device a rod-shaped lamp 22 extending parallel to the outer surface of the form 1 in the longitudinal direction thereof. In conjunction with the transparent hollow profile element 14 of the form 19 the portion of the textile product 15 detected by the pattern detection device 21 is illuminated from the rear, so that the contrasts are intensified, particularly when a pattern flaw exists. As will be explained hereinafter, there is a portion-wise inspection for stitch pattern flaws in the textile product 15 accompanied by a rotation of the form 1.

Figure 9A:
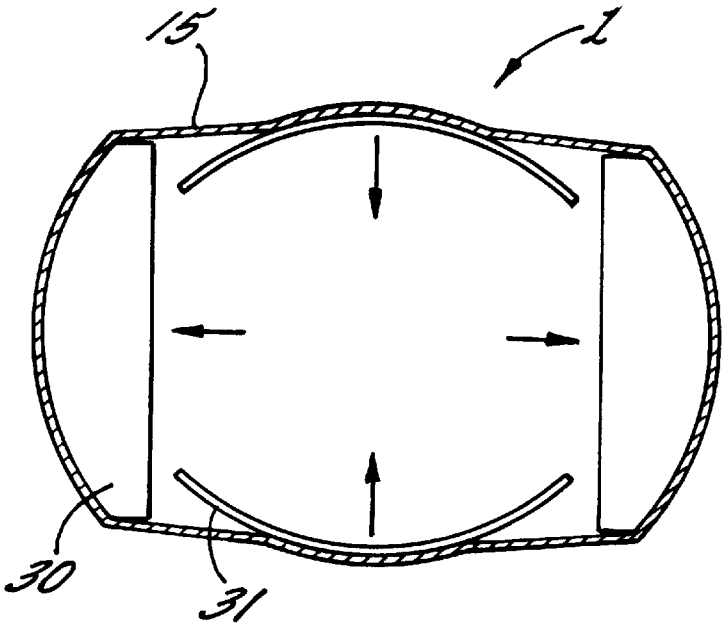
FIG. 9 A cross-section through a form for drawing on textile goods similar to FIG. 5, according to a second embodiment, the form being shown in different settings (FIGS. 9*a* and 9*b*).
Figure 9B:
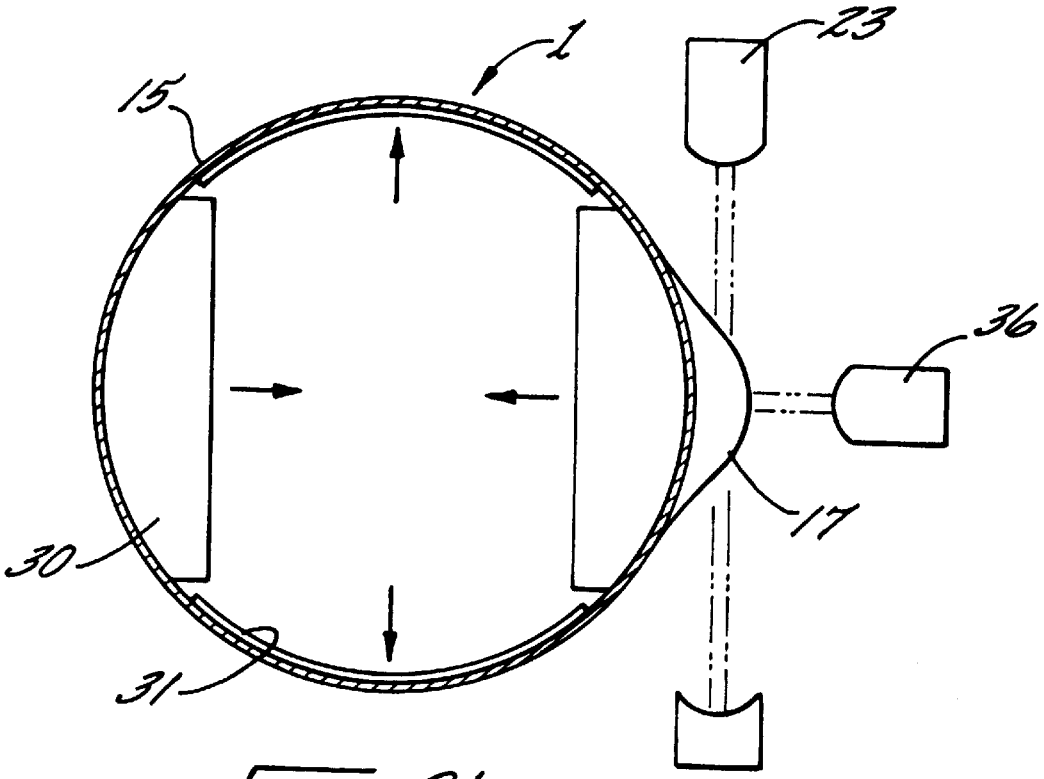

Also in the position detection and inspection station 6 is provided an asymmetry detection sensor 23, which although not shown in FIG. 7 can be seen in FIG. 9*b*. This sensor 23 operates as a light barrier and its detection range is preferably tangentially directly upstream of the circumferential surface of the form 1, but is slightly spaced therefrom so that portions of the textile product 15 engaging smoothly on the outer surface of the form 1 are not located in the detection range of the sensor 23, whereas the reciprocated heel 17 of the product 15 projecting in bead-like manner from the outer surface of the form 1, in the case of a corresponding angular positioning of said form are in the detection range of the sensor 23. Thus, accompanied by the rotation of the form 19 it is possible to detect and determine the position of the reciprocated heel 17 relative to the angular position of the form 1. Corresponding to the signals of the sensor 23 and the corresponding angular position of the form a not shown control unit can control the corresponding drive motor of the second rotating device 9 in order to rotate the textile product 15 into a predetermined alignment.

In the position detection and inspection station 6 is also provided a twist detection sensor 36, which detects the twist of the sock on the form, i.e. a twisting of the sock about the form longitudinal axis. The sensor 36 can e.g. operate optically and can e.g. detect a tracer thread visible under UV light, which has been woven longitudinally into the sock.

In the draw-off station 7 is provided a draw-off device 24, which has a pair of pivotable conveyor units 25 with in each case a pair of revolving conveyor belts 26. The draw-off device 24 substantially corresponds to the draw-on device 18 and can also be pivoted up to and away from the form 1 in order to draw off the textile goods 15 in the same way as has been described relative to the draw-on device.

In the draw-off station 7, below the form 1, is provided a conveying away means 27 with a pair of facing conveyor units 28 with associated conveyor belts 29, which take over the drawn off textile goods 15 and convey them away e.g. to a shaping station.

In order to eliminate or at least significantly reduce twisting of socks, the draw-off device 24 can be so constructed or regulated that it only comes into engagement with the sock portion which has just slid from the form e.g. by inclining the conveyor units 25. According to another embodiment the twist can also be eliminated in that the form 1 is rotatable with respect to the conveying away means 27, which can be looked upon as part of the draw-off device, so that on drawing off the sock the sock part still on the form 1 is rotated compared with the sock portion in engagement with the conveying away means 27. In this case the draw-off device 24 can be rotated together with the form 1 with respect to the conveying away means 27 or the latter can be rotated, whereas the form 1 and draw-off device 24 are not rotated. The relative rotation is then controlled by the control device as a function of the twist detected by the twist detection sensor 36.

According to another embodiment shown in FIG. 9 the draw-off device and draw-on device are integrated into the form 1. As shown in FIGS. 9*a* and 9*b*, the form 1 has a pair of facing conveyor belt portions 30 with in each case a substantially crescent-shaped cross-section, into which can be integrated a pair of revolving conveyor belts and strands of the belts located on the outside can project over the outer surface. Above the same the form 1 has a pair of facing, substantially shell-like form portions 31 rotated by 90° relative to the conveyor belt portions 30. The conveyor belt portions 30 and/or the form portions 31 can be moved radially. In order to draw a sock 15 onto the form 1 the form portions 31 are moved radially inwards and the conveyor belt portions 30 radially outwards, so that the sock 15 can be drawn with low friction on the form portions 31 and high friction on the corresponding conveyor belts (FIG. 9*a*).

In order to uniformly tension the textile product 15 for inspecting the stitch pattern and/or determining the position of the reciprocated heel, the form portions 31 are moved radially outwards whereas the conveyor belt portions 30 can be moved radially inwards (FIG. 9*b*). To draw the textile product 15 from the form 1, the latter can be set in a position corresponding to the draw-on position (FIG. 9*a*).

The function and operation of the apparatus will now be described

Firstly a sock 15, e.g. located in a basket, is slipped in orientation-free manner by an operator 32 in a single manipulation with the top on the lower end 16 of the form 1 located in the slip-on station 4 (FIG. 1). The remaining sock portion hangs freely downwards in a random position.

After slipping on the sock the revolving plate 2 is rotated by 90° in order to bring the slipped-on sock into the draw-on station 5, where the draw-on device 18 (FIG. 6) is pivoted up to the form 1 and the sock is completely drawn onto said form 1 by the conveyor belts 20, which preferably have a foamed polyurethane covering. The conveyor units 19 of the draw-on device 18 are again pivoted away from the form 1 at the end of the draw-on process.

The revolving plate 2 is then rotated by a further 90° by the first rotating device 8 in order to move the sock 15 drawn onto the form 1 into the position detection and inspection station 6. In said station 6 the form 1 is rotated by at least 360° about its vertical longitudinal axis by the corresponding drive motor of the second rotating device 9. The stitch pattern of the sock 15 is portionwise inspected by the pattern detection device 21 and a corresponding evaluating device. In addition, the position detection sensor 23 detects the position of the bead-like projecting reciprocated heel 17, if the latter is rotated into the detection range of the sensor 23. The corresponding signals of the position detection sensor 23 are transferred to a not shown control device together with the corresponding rotation angle of the form 1, which can e.g. be determined by means of an encoder connected to the corresponding drive motor of the second rotating device 9. The control device determines therefrom the alignment of the sock 15 and correspondingly controls the second rotating device 9 in order to rotate the form 1 in such a way that the sock is aligned or straightened in a predetermined position.

During the rotation about 360° a twist of the sock 15 is detected in the detection and inspection station by the twist detection sensor 36. The displacement by which an upper end portion is rotated compared with a lower end portion and optionally compared with a central portion of the sock, is transmitted to the control device and stored there in a storage means.

Finally the revolving plate 2 is again rotated by 90° in order to move the inspected, straightened sock into the draw-off station 7, where the sock 15 is drawn off and this preferably takes place in such a way that the reciprocated heel 7 and toe seam 33 come to rest between the conveyor belts 29 of the conveying away means 27.

In accordance with the stored twist of the sock 15, during the drawing off process the form is rotated counter to the twisting direction relative to the draw-off device or conveying away means, in order to eliminate the twist.

In place of the described position detection with the aid of the bead-like projecting reciprocated heel, the straightening of the sock 15 can also be brought about in that the position detection sensor 23 is directed onto the toe seam 33 and detects the latter.

The apparatus is more particularly characterized in that the textile goods are automatically aligned or straightened and simultaneously the stitch pattern thereof is inspected. The tubular textile product is drawn onto a cylindrical form, so that an asymmetry of shape such as a reciprocated heel can be very easily detected and used for determining the alignment and also the sock is uniformly stretched and a correspondingly uniform stitch pattern facilitates flaw detection.

We claim:

1. Method for inspecting a substantially tubular textile product for faults, wherein the textile product is drawn onto a substantially cylindrical transparent form having a longitudinal axis and illumination means located within the form, the form with the textile product drawn onto the form is rotated about its longitudinal axis, and the textile product is inspected for faults under rotation of the form, wherein textile product portions are successively detected, by means of an optical pattern detection device and compared with one another while the textile product extends in a single-layer between the illumination means and the optical pattern detection device.

2. Method according to claim 1, wherein for straightening a substantially tubular textile product, which has an asymmetry, during rotation the position of the asymmetry and the position of the form are detected and the form is rotated into a predetermined position in accordance with the determined position of the asymmetry.

3. Method according to claim 2, wherein the textile product is drawn onto the form in such a way that the textile product, with the exception of the asymmetry, engages smoothly on the form, said asymmetry projecting from the form, and the asymmetry projecting from the form is detected.

4. Method according to claim 2, wherein the form with the textile product drawn onto the form is rotated by at least 360°.

5. Method for straightening a substantially tubular textile product, wherein the textile product is drawn onto a form having a longitudinal axis; wherein the textile product drawn onto the form undergoes inspection for twisting in the longitudinal direction of the form so as to detect twist of the textile product, the textile product is drawn off the form by a draw-off device and during drawing off, the form is rotated about the longitudinal axis relative to the draw-off device in response to the detected twist of the textile product so that by rotating the form relative to the draw-off device, a textile product portion to be drawn off is rotated relative to a textile product portion still drawn on the form.

6. Method according to claim 5, wherein for straightening a substantially tubular textile product, which has an asymmetry, during rotation the position of the asymmetry and the position of the form are detected and the form is rotated into a predetermined position in accordance with the determined position of the asymmetry.

7. Apparatus for straightening a substantially tubular textile product which has an asymmetry, said apparatus comprising at least one substantially cylindrical form having a longitudinal axis; a rotating device for rotating the form about the longitudinal axis; a detecting device for detecting a position of the asymmetry relative to an angular position of the form when rotating the form with the textile product drawn onto the form, said detecting device having a sensor for detecting the presence of the asymmetry in a predetermined area; a control device for controlling the rotating device in response to the detected position of the asymmetry and the corresponding position of the form; a slip-on station for slipping the textile product onto the form, a draw-on device for drawing the textile product onto the form including at least one revolving draw-on belt and being integrated into the form; an inspection station for inspecting the textile product drawn onto the form for faults; and a draw-off station for drawing the textile product off the form.

8. Apparatus according to claim 7, comprising a plurality of forms movable to the particular stations.

9. Apparatus according to claim 7, wherein the draw-on device has several conveyor units movable relative to the form with in each case at least one draw-on part.

10. Apparatus according to claim 7, wherein the form has a circumference which is larger than a minimum circumference of the textile product in an untensioned state and which is so dimensioned that in the vicinity of the asymmetry the textile product projects from the form and smoothly engages on said form in other areas.

11. Apparatus according to claim 7, wherein the form has several components movable towards one another and radially adjustable with respect to the longitudinal axis.

12. Apparatus for inspecting and straightening a substantially tubular textile product for faults, said apparatus comprising a substantially cylindrical form, a draw-on device for drawing the textile product on the form, an inspection device for inspecting a stitch pattern of the textile product drawn onto the substantially cylindrical form, said inspecting device being provided with illumination means, an optical pattern detection device for detecting the stitch pattern, a storage device for storing a detected stitch pattern, a comparator for comparing a detected stitch pattern with a stored stitch pattern, an evaluating unit for evaluating the comparison result, a draw-off device for drawing the textile product from the form, a rotating device for rotating the form relative to the draw-off device about the longitudinal axis and a control device for controlling the rotating device during the drawing of the textile product off the form responsive to the output of said evaluating unit.

13. Apparatus according to claim 12, further comprising a detection unit for detecting a twist of the textile product along the form and wherein the control unit is provided for controlling the rotating device in response to the detected twist.

14. Apparatus according to claim 12, wherein the draw-off device has several conveyor units movable relative to the form with in each case at least one revolving draw-off belt.

* * * * *

UNITED STATES PATENT AND TRADEMARK OFFICE

CERTIFICATE OF CORRECTION

PATENT NO. : 5,904,279

DATED : May 18, 1999

INVENTOR(S) : Bertram et al.

It is certified that error appears in the above-identified patent and that said Letters Patent is hereby corrected as shown below:

On the title page, item [73], in the Assignee's address, "Weiheim" should read --Weilheim/Teck--.

On the title page, item [56], in the References Cited, FOREIGN PATENT DOCUMENTS, line 2, "10/1951" should read --9/1953--.

Signed and Sealed this

Twelfth Day of October, 1999

*Attest:*

Q. TODD DICKINSON

*Attesting Officer*

*Acting Commissioner of Patents and Trademarks*